United States Patent [19]

Blair

[11] 4,120,253

[45] Oct. 17, 1978

[54] TUBULAR LOOP FORMING TOOL FOR SEWING MACHINES

[76] Inventor: Thomas O. Blair, 8026 SE. Powell Blvd., Portland, Oreg. 97206

[21] Appl. No.: 787,859

[22] Filed: Apr. 15, 1977

[51] Int. Cl.[2] ..... D05B 29/00; D05B 35/00

[52] U.S. Cl. ..... 112/151; 112/235

[58] Field of Search ..... 112/151, 141, 143, 136, 112/235, 240, 139, 150

[56] References Cited

U.S. PATENT DOCUMENTS

| | | | |
|---|---|---|---|
| 423,817 | 3/1890 | Robinson | 112/151 |
| 560,416 | 5/1896 | Laubscher | 112/143 |
| 641,098 | 1/1900 | Gillis | 112/143 |
| 718,818 | 1/1903 | Campbell | 112/151 |
| 1,260,772 | 3/1918 | Hemleb | 112/235 X |
| 2,986,106 | 5/1961 | Rogers | 112/151 |
| 3,763,801 | 10/1973 | Bozzi | 112/151 X |

*Primary Examiner*—Peter Nerbun
*Attorney, Agent, or Firm*—Oliver D. Olson

[57] ABSTRACT

A tubular loop forming tool for sewing machines replaces the normal presser foot attached to the sewing machine presser bar, thereby providing the function of the presser foot and also serving as a gauge to control the size of a tubular loop being sewn from fabric material, the gauge preferably being adjustable so various size tubular loops may be formed.

6 Claims, 4 Drawing Figures

TUBULAR LOOP FORMING TOOL FOR SEWING MACHINES

BACKGROUND OF THE INVENTION

This invention relates to the art of sewing, and more particularly to a tool for forming a tubular loop in fabric material.

Dressmakers and seamstresses often find it desirable to provide belts, edgings, ornamental bows, hairribbons and similar articles from the same or different cloth material that is used in the making of a dress, suit or other garment. Such articles are made by doubling a narrow strip of cloth material longitudinally, and stitching it together along the line which defines the size of the resulting tubular loop, and then turning the loops inside out, as by means of my everting method and tool disclosed in my U.S. Pat. No. 3,637,119.

The doubling and sewing of the material to form the tubular loop heretofore has been done on a sewing machine without mechanical aid, requiring great care and patience in forming and maintaining a loop of uniform width throughout the extent of the material. Attachments available for sewing machines to permit the forming of loops of various sizes with control, accuracy and speed have not been available.

SUMMARY OF THE INVENTION

In its basic concept, this invention provides a sewing machine presser foot having a lateral section around which a lateral portion of fabric may be folded and guided as the fabric is moved longitudinally relative to the sewing machine needle, whereby the latter forms a tubular loop of the folded fabric.

It is by virtue of the foregoing basic concept that the principal objective of this invention is achieved; namely, the provision of a tool by which to form tubular loops of fabric material with speed and precision.

Another important object of this invention is the provision of a tool of the class described which is readily adjustable to permit variation of the size of the loop of the folded fabric material.

Another object of this invention is to provide a tool of the class described which is readily attached to the presser bar of a conventional sewing machine.

Still another object of this invention is to provide a tool of the class described which is of simplified construction for economical manufacture.

The foregoing and other objects and advantages of this invention will appear from the following detailed description, taken in connection with the accompanying drawings of preferred embodiments.

DESCRIPTION OF THE PREFERRED EMBODIMENTS

Figure 1:
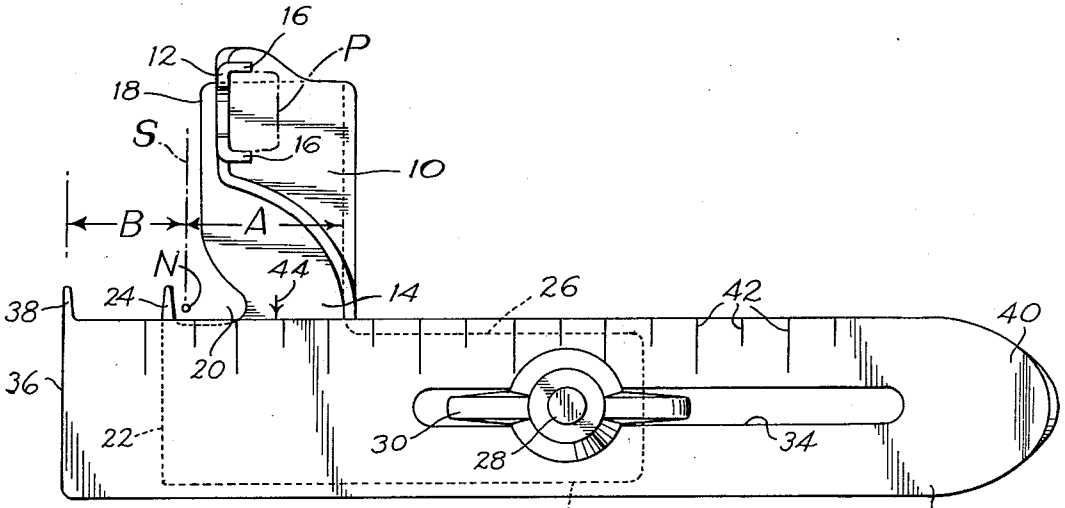
FIG. 1 is a plan view of a loop forming tool embodying the features of this invention.

The tubular loop forming tool of this invention comprises a unitary body which includes an intermediate, angular, or otherwise offset shank member 10, an upper, vertical, slotted connecting member 12 and a lower, horizontal presser foot member 14 extending at right angles to the connecting member 12. The upper connecting member 12 has a pair of spaced lugs 16 adapted to engage the presser bar P of a sewing machine and to be secured thereto by means of a conventional thumb screw supplied with the machine and shown in broken lines in FIG. 3.

The shank member 10 provides clearance between the sewing machine needle N and the inner side of the presser foot member 14, as indicated by the letter "A," for receiving the excess of fabric overlying the foot member outside the switch line. The clearance A may be varied as required for various widths of excess fabric, by varying the angular slope or other form of offset of the shank member 10.

The open edge 18 of the rear portion of the foot member 14 terminates inwardly of the sewing line S so that the line of stitching of the material may pass rearwardly without interference. The forward end of the edge 18 is contoured to provide a rearwardly open notch 20 which receives the needle N and provides ample clearance for the upper and lower lapped fabric material to come together at the sewing point of the needle and to allow the line of stitching to pass rearwardly of the foot member.

The foot member 14 extends forwardly of the notch 20 to define a loop forming fold gauge edge 22 located outwardly of the needle N. Thus, this forward portion of the foot member extends across the longitudinal sewing line S. The edge preferably extends rearwardly to a tapered, rearwardly extending point 24. The lower side of the point is beveled to minimize the radius of the fold of material doubled back over the forward portion of the foot member 14.

Figure 2:
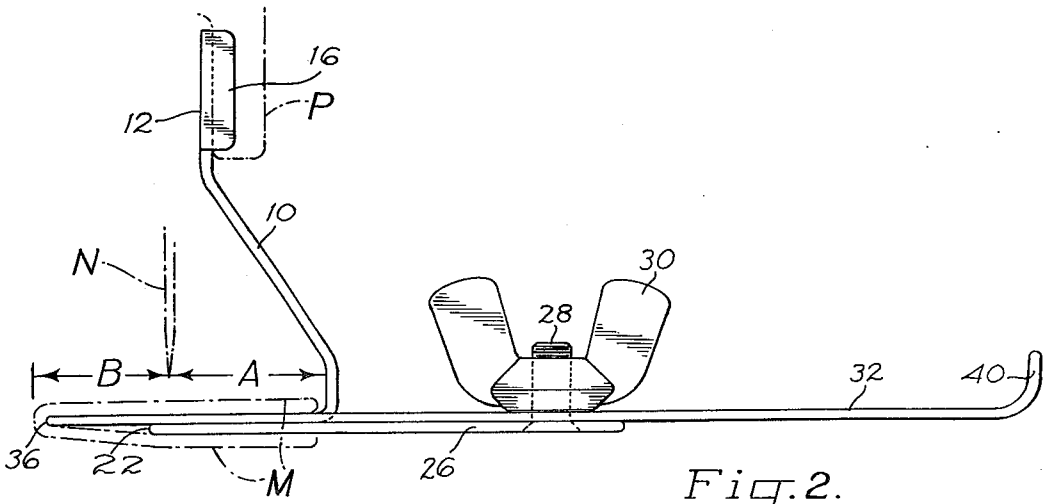
FIG. 2 is a front elevational view of the tool as seen from the operator's side of the sewing machine.
Figure 3:
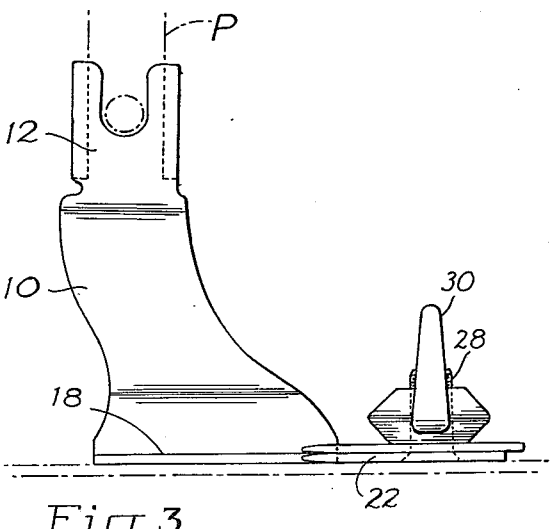
FIG. 3 is a side elevational view of the tool as seen from the left in FIG. 2.

In the embodiment illustrated in FIGS. 1–3, an elongated flat bar 26 extends laterally from the foot member 14 in the direction away from gauge edge 22. Positioned near the extended end of the bar 26 is a permanently affixed screw 28 adapted to receive a wing nut 30. Mounted on the bar is a transversely adjustable fold gauge member 32 having a slot 34 provided therein through which the screw 28 passes, permitting the gauge member 32 to be secured in position by the wing nut. The gauge edge 36 of the member 32 is provided with a projection 38 shaped to correspond with the projection 24 of the foot member 14. Its top surface is beveled, permitting the projections 24 and 38 to form a single pointed projection of minimum radius around which the material may be folded when forming a minimum sized loop.

The opposite end of the fold gauge member 32 is provided with an upwardly projecting finger tab 40 which permits easy manual adjustment of the member 32 laterally relative to the foot member 14. Position markings 42 are provided along one edge of the member 32 to be referenced to index mark 44 inscribed on the foot member 14, thereby providing a ready reference to the loop size to be formed, as indicated by the dimension "B."

Figure 4:
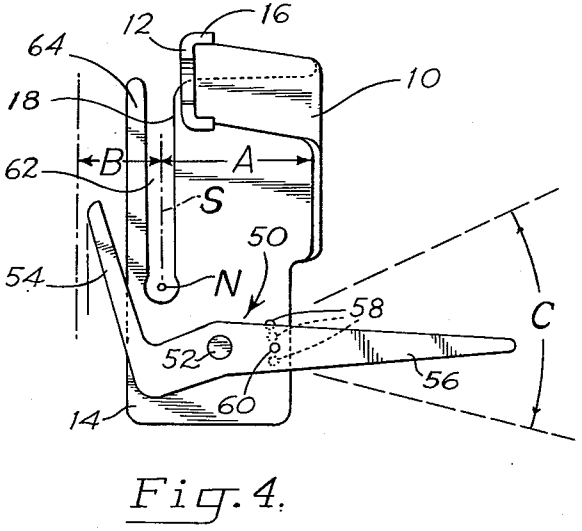
FIG. 4 is a plan view of an alternate form of tool embodying the features of this invention.

In the alternate embodiment illustrated in FIG. 4, the laterally extended bar 26, gauge member 32 and interengaging screw 28 of FIG. 1 are replaced with a gauge member 50 secured to the foot member 14 by a pivot pin 52. The gauge member has a finger-like portion 54 and a handle portion 56. Positioned on a radius from the pivot 52 are a series of spaced detents 58 in the foot member 14. These are adapted selectively to seat a downward depression 60 in the handle portion 56, permitting the gauge member to be adjusted arcuately within the range of the arc "C," thereby varying the loop size as established by the finger 54.

The foot member 14 is provided with a rearwardly open slot 62 the inner end of which receives the needle N and the length of which registers with the sewing line S, thereby permitting the sewn material to pass rearwardly beyond the foot member. The slot forms a finger 64 which, like point 24, established the minimum loop size which may be sewn with this arrangement, when the finger 54 is adjusted to overlie the finger 64.

In operation, the loop forming tool is secured on the presser bar P of a sewing machine, in place of the standard presser foot. A portion of the fabric material M, shown by broken lines in FIG. 2, from which the loop is to be formed, is passed under the foot member 14 and secured in place by lowering the presser bar of the sewing machine. The material extending laterally outward beyond the edge 36 of gauge member 32, or finger 54 of gauge member 50, then is folded back over the gauge member and foot member 14, with its edge being positioned near the bottom end of the shank member 10. Sewing progresses with the folded material being held snugly against the guide edge of the guide member, while the finished loop passes rearwardly to the back of the sewing machine away from the operator.

It is apparent that the size of the loop is determined by the position of the edge 36 or finger 54 of the corresponding guide member, relative to needle N. The smallest possible loop is formed with the guide member 32 removed from the bar 26. The next smallest loop is formed by superimposing point 38 on point 24, or finger 54 on finger 64. Progressively larger loops are formed by adjusting edge 36 or finger 54 laterally outward relative to the needle N.

The gauge member 32 or 50 may be omitted and the gauge edge 22 of the foot member 14 may be chosen to extend laterally outward from the position of the needle N to any distance desired. A plurality of such tools thus may be provided, each with a different spacing between the edge 22 and needle N. It is to be understood that since the position of the needle is fixed relative to the presser bar P, the spacing of the edge 22 from the needle may be determined, for example, by the lateral spacing of the edge 22 from a vertical surface of the vertical connecting member 12, or from the edge 18 of the foot member 14.

The rearwardly projecting point 24 and finger 64, and the rearward end of the forward portion of the foot member 14, are located closely adjacent the needle N, and serve to hold the underlying fabric in place as the needle works upward through it. The point 24 and finger 64 may be omitted, but if provided they need not extend rearwardly beyond the needle to any substantial extent, although the longer finger 64 does contribute a fabric guiding function. In any event, it is required that the edges 22 and 36, or finger 54, extend rearward at least to the transverse line of the needle N, in all positions of adjustment of the edge 36 or finger 54, to insure a uniform width of loop formed in the fabric.

Although the foregoing description refers to forming a tubular loop in fabric material, it is to be understood that the tool may be used to form loops in any readily flexible material such as sheets of synthetic plastic, leather, and other similar materials, all of which are intended to be included in the term "fabric" as employed in the appended claims.

It will be apparent to those skilled in the art of various changes may be made in the size, shape, type, number and arrangement of parts described hereinbefore, without departing from the spirit of this invention.

Having now described my invention and the manner in which it may be used, I claim:

1. A sewing machine loop forming tool, comprising:

(a) a body having an upper end portion adapted for attachment to the presser bar of a sewing machine, (b) a foot member on the lower end of the body having a forward portion dimensioned to extend laterally across the longitudinal sewing line of the needle of a sewing machine and a rearward portion having an inner side edge disposed laterally inward of said sewing line, whereby to allow rearward movement of fabric stitched together by the needle of the sewing machine, and (c) fabric fold gauge means on the forward portion of the foot member having a fabric folding edge located on the side of the sewing line opposite the said inner side edge of the rearward portion of the foot member and extending rearwardly at least substantially to the transverse line of the needle of a sewing machine, for folding fabric extending from under the foot member back over the latter for stitching the lapped portions of fabric together as the fabric progresses rearwardly through the sewing machine.

2. The sewing machine loop forming tool of claim 1 wherein the body includes a shank member interconnecting the upper end portion and the lateral outer side of the foot member opposite the folding edge of the gauge means.

3. The sewing machine loop forming tool of claim 1 wherein the gauge means comprises the lateral end of the forward portion of the foot member that extends across the longitudinal sewing line of the needle of a sewing machine.

4. The sewing machine loop forming tool of claim 1 wherein the gauge means comprises a gauge member mounted on the foot member for adjustment laterally thereof to varying distances on the side of the sewing line opposite the said inner edge of the rearward portion of the foot member.

5. The sewing machine loop forming tool of claim 4 wherein the guage member is mounted on the foot member for linear adjustment of the folding edge laterally of the foot member.

6. The sewing machine loop forming tool of claim 4 wherein the gauge member is mounted on the foot member for pivotal adjustment of the folding edge laterally of the foot member.

* * * * *